US006439214B1

(12) United States Patent
Yew

(10) Patent No.: US 6,439,214 B1
(45) Date of Patent: Aug. 27, 2002

(54) LINEAR SOLENOID AUTOMOTIVE EMISSION CONTROL VALVE

(75) Inventor: Kwang Yew, Chatham (CA)

(73) Assignee: Siemens Automotive Inc., Chatham (CA)

( * ) Notice: Subject to any disclaimer, the term of this patent is extended or adjusted under 35 U.S.C. 154(b) by 0 days.

(21) Appl. No.: 09/929,813

(22) Filed: Aug. 14, 2001

(51) Int. Cl.[7] ..... F02M 25/07
(52) U.S. Cl. ..... 123/568.21; 251/129.15
(58) Field of Search ..... 123/568.21; 251/129.15; 335/262, 219

(56) References Cited

U.S. PATENT DOCUMENTS 5,669,364 A * 9/1997 Everingham ..... 123/568.21
5,947,092 A * 9/1999 Hussex et al. ..... 251/129.15
6,062,536 A * 5/2000 Bircann ..... 251/129.15
6,189,519 B1 * 2/2001 Press et al. ..... 123/568.21
6,247,461 B1 * 6/2001 Smith et al. ..... 123/568.21

* cited by examiner

*Primary Examiner*—Paul J. Hirsch

(57) ABSTRACT

An automotive emission control valve, such as an EGR valve, has a solenoid for operating a valve element. The solenoid stator has an annular air gap disposed within an electromagnet coil. An annular wall of an armature is disposed in the air gap. The armature is displaced by magnetic flux in the air gap. The air gap is cooperatively defined by juxtaposed walls of the stator that are spaced radially a distance greater than radial thickness of the annular wall of the armature. The annular wall of the armature is disposed radially intermediate the stator walls and spaced from each stator wall. The radially inner stator wall is tapered. Lost-motion is present between the armature and valve element so that initial armature displacement is not transmitted to the valve element. Dimensions of the stator walls and armature at the air gap may be selected to improve linearity of operation.

13 Claims, 5 Drawing Sheets

LINEAR SOLENOID AUTOMOTIVE EMISSION CONTROL VALVE

FIELD OF THE INVENTION

The invention relates generally to electric-actuated automotive emission control valves, and more particularly to an exhaust gas recirculation (EGR) valve for an internal combustion engine that powers an automotive vehicle.

BACKGROUND OF THE INVENTION

An EGR valve may comprise a solenoid as an electric actuator. The solenoid comprises an electromagnet coil and a stator having an air gap at which magnetic flux acts on an armature. The armature motion is transmitted to a valve member to allow flow through a passageway of the valve. Armature motion is resisted by a return spring that acts on the armature, either directly or via the valve member, to bias the armature to a position that causes the valve member to close the passageway.

In a linear solenoid valve, displacement of the armature, and also of the valve member when the valve member is displaced in exact correspondence with the armature, should theoretically bear a relationship of direct proportionality to the electric current in the solenoid coil. In other words, a graph plot of armature displacement versus electric current for such a valve should start at the origin of the graph and extend from the origin at a constant slope. For any one or more of various reasons that will be discussed, a graph plot of armature displacement versus electric current for an actual linear solenoid valve is apt not to correspond with the theoretical graph plot that would define an ideal linear solenoid valve.

A known linear solenoid EGR valve comprises a stator having an upper stator part that is disposed at an upper end of the coil and a lower stator part at the lower end of the coil. These two parts have respective cylindrical walls, one tapered and the other non-tapered, that fit into the open center of the coil, approaching each other from opposite ends of the coil. The juxtaposed ends of the two walls are spaced apart within the open interior of the coil, and their construction and arrangement define an annular air gap disposed circumferentially around the armature. Electric current in the coil creates magnetic flux that passes from one wall across the air gap to the armature, through the armature, and back across the air gap to the other wall. The flux causes magnetic force to be applied to the armature, and the axial component of that force acts to displace the armature along the centerline of the solenoid. While certain changes in coil current will change the magnetic flux spanning the air gap, armature displacements resulting from those current changes may also change the magnetic flux pattern, the flux density, and/or how that flux density acts on the armature, and it is such changes that may impart non-linearity to a desired linear relationship of armature displacement to coil current.

The particular construction and arrangement of the juxtaposed walls of the upper and lower stator parts that define the air gap, and the need to create a certain minimum current flow in the solenoid coil before any displacement of the armature can occur, are two causes for a valve to have a displacement versus current characteristic that departs from a perfectly linear one. Certain conditions that are present at initial valve opening but not thereafter, such as static friction and less than perfect pressure compensation, and the force that must be exerted by the return spring to assure that the valve is closed when no current flows in the coil, are causes of valve non-linearity. The need to build a certain minimum electric current in the coil before any armature displacement can occur creates an inherent offset in a graph plot of armature displacement versus coil current. Because of the offset, graph plot of armature displacement versus coil current cannot pass through the origin of the graph, and so the plot will be inherently non-linear even if the plot has a constant slope once the armature displacement begins. Additional non-linearity would be manifested by variations in slope of the graph plot.

Where flow through the valve is proportional to armature displacement, the functional relationship of flow to electric coil current will have similar non-linearity. In an EGR valve, such non-linearity may complicate the control strategy for accurately metering exhaust gas into the engine intake system over the flow range involved for the engine.

It would therefore be desirable if improved definition and better linearity could be obtained in the functional relationship of valve opening to coil current in an actual linear solenoid valve, and especially at initial valve opening and over a contiguous range of relatively smaller valve openings. It is believed that such improvements would be especially beneficial when metering small amounts of exhaust gas for engine exhaust gas recirculation.

It would also be desirable to provide a basic valve construction that can be adapted by valve designers to create actual valves possessing desired functional characteristics conforming to customer specifications.

SUMMARY OF THE PRESENT INVENTION

It is an object of this invention to satisfy such desires.

One general aspect of the invention relates to an emission control valve for controlling flow of gases with respect to combustion chamber space of an internal combustion engine. The valve comprises a valve body comprising a passageway having an inlet port for receiving gases, an outlet port for delivering gases to the combustion chamber space, a valve element that is selectively positioned to selectively restrict the passage, and an electric actuator for selectively positioning the valve element. The actuator comprises a solenoid having an electromagnet coil and a stator associated with the coil, and the stator has an annular air gap disposed within a central interior space of the coil concentric with the centerline. The valve further comprises an armature that comprises an annular wall disposed in the air gap concentric with the centerline and that is displaced along the centerline as a function of magnetic flux created in the air gap by electric current in the coil to operate the valve element. The air gap is cooperatively defined by juxtaposed walls of the stator that are concentric with the centerline and spaced apart radially a distance greater than radial thickness of the annular wall of the armature, and the annular wall of the armature is disposed radially intermediate the stator walls and spaced radially from each stator wall.

Another general aspect relates to an emission control valve as just described wherein the valve forms part of an exhaust gas recirculation system of an internal combustion engine.

Still another aspect relates to an emission control comprising a valve body comprising a passageway having an inlet port for receiving gases, an outlet port for delivering gases to the combustion chamber space, a valve element that is biased closed and selectively operated to selectively restrict the passage, an electric actuator comprising a solenoid for selectively operating the valve element, and an armature that is displaced to selectively operate the valve element by magnetic force created by electric current in the solenoid, wherein the magnetic force decreases as a function of unit current in the coil over a range of initial armature displacements. A lost-motion is present in an operative coupling of the armature to the valve element to prevent the armature from operating the valve element until the armature has been displaced beyond the range of initial displacements.

Other principal aspects, features and advantages of the invention will become apparent to those skilled in the art upon review of the following drawings, the detailed description and the appended claims.

DESCRIPTION OF THE PREFERRED EMBODIMENT

Figure 1:
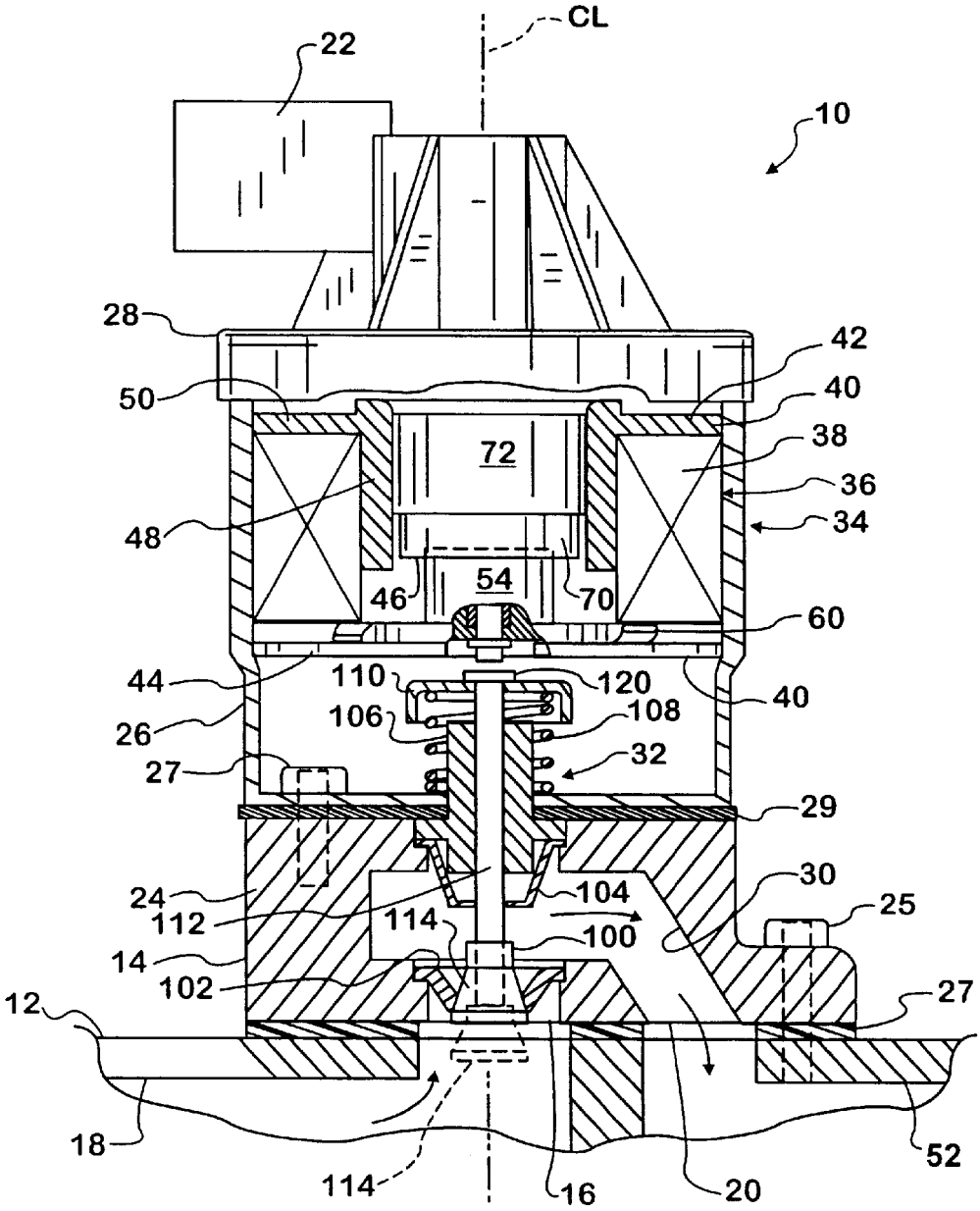
FIG. 1 is a cross section view, in elevation on an engine, of an exemplary EGR valve in accordance with the present invention.

FIG. 1 shows an EGR valve 10, having an imaginary longitudinal centerline CL, mounted upright on an internal combustion engine 12. Valve 10 comprises a body 14 having an inlet port 16 in registry with a portion 18 of an exhaust gas passage coming from an exhaust system of engine 12 and an outlet port 20 in registry with another portion 22 of the exhaust gas passage leading to an intake system of engine 12.

Valve body 14 comprises a metal base 24 disposed against, and fastened to, engine 12 by fasteners 25 with an intervening gasket sandwiched between the bottom face of base 24 and a top surface of engine 12. Body 14 further comprises an open-top, walled cylindrical shell 26 disposed on, and fastened to, base 24 by fasteners 27, and a cap 28 secured to, and closing the open top of, shell 26. A spacer 29 is disposed between shell 26 and base 24. Base 24 has an internal passageway 30 running between ports 16 and 20.

Figure 2:
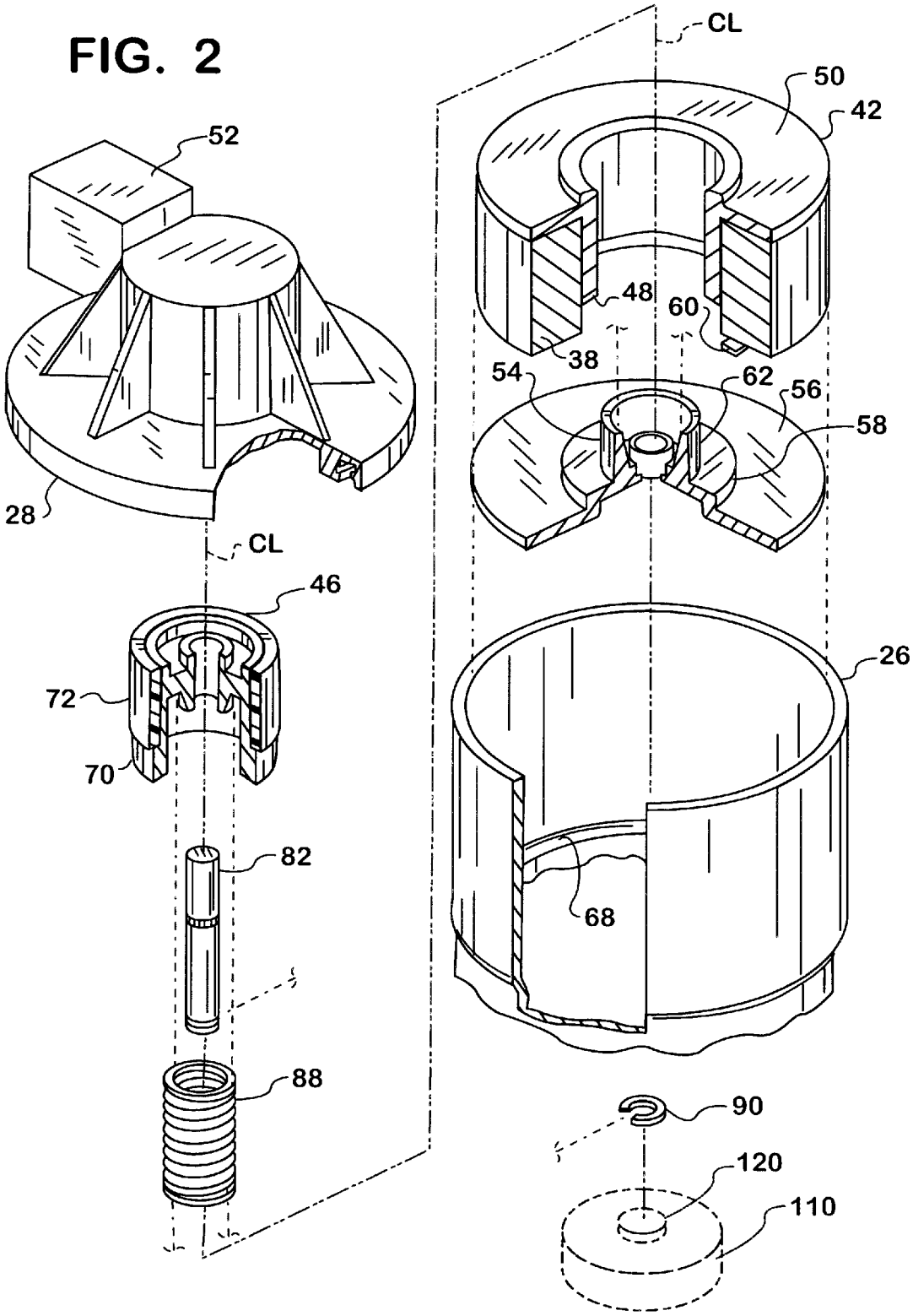
FIG. 2 is an exploded perspective view of the valve of FIG. 1.
Figure 3:
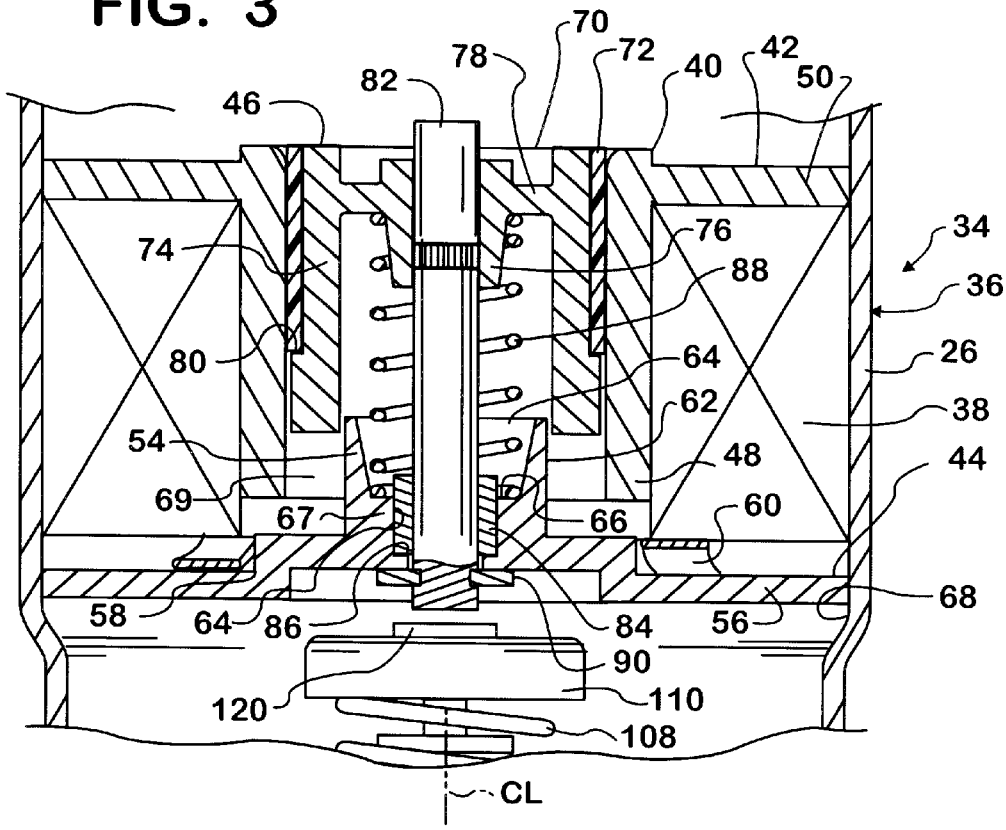
FIG. 3 is a fragmentary view of a central portion of FIG. 1 on a larger scale with additional cross sectioning.

Valve 10 comprises a valve mechanism 32 and an electric actuator 34 for operating valve mechanism 32. Actuator 34 comprises a solenoid 36 having an electromagnet coil 38 housed within shell 26 and an associated stator 40. The latter comprises an upper ferromagnetic stator part 42 and a lower ferromagnetic stator part 44, both housed within shell 26, and that portion of the shell side wall between the two parts 42, 44. FIGS. 2 and 3 show greater detail.

Solenoid 36 is disposed with its own centerline concentric with centerline CL and serves to selectively position an armature 46 along centerline CL. Upper stator part 42 comprises a uniformly thick, circular cylindrical wall 48 and an annular flange 50 disposed proximate, and at a right angle to, the upper longitudinal end of wall 48. Below flange 50, wall 48 fits closely within an open cylindrical interior of coil 38, while flange 50 is disposed against and in covering relation to an upper end of coil 38. Flange 50 contains a suitable through-opening (not shown) that allows for electric connection of the ends of wound magnet wire forming coil 38 to be made in any suitable manner to electric terminals (not shown) that are disposed within a surround 52 of cap 28 to form an electric connector by which valve 10 can be connected to a remote electric circuit for operating valve 10. Coil 38 is disposed on a plastic bobbin (not specifically shown) that comprises a central cylindrical core and circular flanges at opposite ends, and accordingly wall 48 can fit snuggly within the central bobbin core and flange 50 can fit flat against the upper bobbin flange.

Lower stator part 44 comprises a non-uniformly thick, circular cylindrical wall 54 and an annular flange 56 disposed at, and at a right angle to, the lower longitudinal end of wall 54. Above flange 56, wall 54 enters the open cylindrical interior of coil 38. Flange 56 comprises a shoulder 58 that is circular about centerline CL and serves to create an outer circular margin that is spaced from the lower end of coil 38. A wave spring 60 seats on that margin about shoulder 58 and acts against the lower end of coil 38 to keep the upper end of coil 38 in continuous abutment with flange 50 and thereby compensate for differential thermal expansion as valve 10 experiences temperature changes.

Wall 54 comprises a radially outer surface 62 that describes a right circular cylinder and a radially inner surface 64. Where wall 54 adjoins flange 56, surfaces 62, 64 describe a short right circular cylinder 67 that ends at a shoulder 66. Beyond shoulder 66, surface 64 has a frusto-conical taper that causes that portion of wall 54 that overlaps upper stator wall 48 along centerline CL within the interior of coil 38 to have a uniformly decreasing thickness as it approaches the upper stator part. In this way the radial thickness of wall 54 is different at different locations measured along centerline CL. In particular the taper that surface 64 imparts to wall 54 begins substantially coincident where wall 54 begins to longitudinally overlap wall 48 of upper stator part 44 and from there wall 54 progressively decreases in thickness.

Stator 40 is cooperatively defined by stator parts 42, 44 and the portion of shell 26 that lies between parts 42, 44. Hence, like the two stator parts, shell 26 is also ferromagnetic. Shell 26 contains a shoulder 68 on which lower stator part 44 seats. An outer circular edge of flange 50 of upper stator part 42 is fit to shell 26. Stator 40 thereby defines an annular air gap 69 between walls 48 and 54 within the interior of coil 38 so that when coil 38 is energized by electric current, a resulting magnetic flux is created across the air gap. With armature 46 disposed at air gap 69, the magnetic flux creates magnetic force that is exerted on the armature.

Armature 46 comprises a ferromagnetic part 70 and a non-ferromagnetic part 72. Part 70 comprises a circular cylindrical outer wall 74, a circular cylindrical inner wall 76, and an annular transverse wall 78 that joins walls 74 and 76. Walls 74 and 76 are concentric, with the latter being shorter and wholly disposed within the former. Wall 78 joins wall 76 to wall 74 proximate the upper end of the latter.

Part 72 comprises a circular cylindrical sleeve that is fit to that portion of the outer surface of wall 74 above a shoulder 80. As such, the outer sleeve surface describes a diameter that is greater than the diameter of the outer surface of wall 74 below shoulder 80. This allows the outer sleeve surface to have surface-to-surface contact with the inner surface of wall 48 so that the latter can guide armature 46 for linear travel along centerline CL without magnetic shorting between part 70 and upper stator part 42. In that way, part 72 acts as a bearing for armature 46 that allows the armature to be guided by stator 44 without magnetic shorting. The diameter across the inner surface of wall 74 is greater than the diameter across outer surface 62 of lower stator wall 54 to provide an annular gap that prevents magnetic shorting of armature 46 to lower stator part 44 when armature 46 is displaced within solenoid 36 sufficiently to begin overlapping wall 54.

A cylindrical shaft 82 is fit to the inner surface of wall 76 and joined to that wall in any suitable way to place the shaft centerline coincident with centerline CL and to unite the shaft and armature 46. Shaft 82 has a length that allows it to pass completely through and beyond wall 54 of lower stator part 44. At the location where it passes through the opening circumscribed by the portion of surface 64 below shoulder 66, shaft 82 can slide within an inner surface of a circular cylindrical bearing 84 that is fit to surface 64 concentric with centerline CL and against a shoulder 86. Bearing 84 thus serves to guide shaft 82 as the latter travels with armature 46. Because the assembly that comprises armature 46 and shaft 82 is guided at two spaced apart locations along centerline CL, care is to be taken to assure proper concentricity and tolerances of the various parts involved for avoiding any tendency toward binding of the assembly within solenoid 36 as the assembly travels along centerline CL.

An armature return spring 88 resiliently urges armature 36 along centerline CL in a direction opposite that of the magnetic force that is applied to the armature when coil 38 is energized. Spring 88 comprises helical coil surrounding shaft 82 and having opposite axial ends shaped for seating against shoulder 66 and wall 78 respectively. An annular stop 90 is affixed to the end of shaft 82 that protrudes outward of solenoid 36 beyond lower stator part 44. When coil 38 is not energized, spring 88 forces armature 36 away from the lower stator part to the extent limited by the abutment of stop 90 with the lower stator part, the condition shown by FIG. 3.

With detail of actuator 34 having been described, attention is now directed toward detail of valve mechanism 32. The latter comprises a valve element 100, a seat 102, a shield 104, a bearing 106, a return spring 108, and a spring seat cup 110. Seat 102 comprises a circular annular part that is secured with a gas-tight fit to a wall surface of base 24 extending from inlet port 16. Valve element 100 comprises a cylindrical stem 112 having a valve head 114 at one end forming a pintle for association with seat 102.

Both seat 102 and valve element 100 are concentric with centerline CL. Head 114 has a frustoconical surface that tapers radially inward toward to the interior of base 24. The inner margin of seat 102 has a similarly tapering surface on which the tapered surface of head 114 seats when valve mechanism 32 is closed, as shown by the solid line position of FIG. 1. When valve element 100 moves away from seating on seat 102 toward the broken line position, an annular opening is created between the tapered surfaces. The effective flow area of the annular opening correlates with the distance that head 114 moves away from the seat.

The motion of valve element 100 is guided by bearing 106 through which stem 112 passes with a close sliding fit that strives to minimize friction while preventing intrusion of exhaust gas. Stem 112 also passes through shield 104 with clearance that is large enough to avoid contact between the two while enabling the shield to be effective in directing exhaust gas and heat away from bearing 106. Shield 104 has an outer margin that is held in place by the mounting of bearing 106 on body 12 and a tapered side that ends at a circular inner margin surrounding stem 112.

Spring 108 comprises a helical coil surrounding the portion of bearing 106 that is disposed with the interior of shell 26. One end of spring 108 seats on the bottom shell wall while the opposite end bears against the interior of cup 110, the latter being centrally affixed to the end of stem 112 opposite valve head 114 by a headed fastener 120. Spring 108 resiliently urges valve member 110 to force head 114 to seat on seat 102, as shown by the solid line position of FIG. 1.

Figure 4:
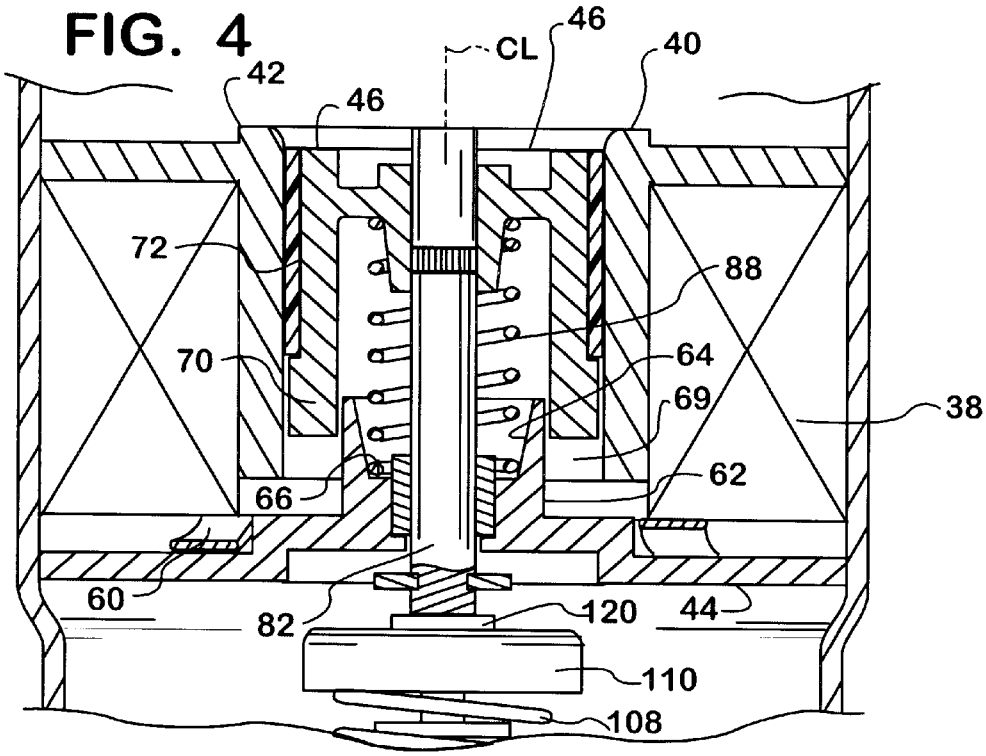
FIG. 4 is view like FIG. 3 showing one condition of operation.

When coil 38 is not being energized, valve 10 assumes the condition shown in FIGS. 1 and 3 where mutually confronting flat surfaces of the end of stem 82 and the head of fastener 120 are spaced apart a certain distance. The flat surface at the lower end of wall 48 is disposed to just slightly overlap the upper end of wall 54. When a certain minimum electric current flows in coil 38, armature 46 and stem 82 will commence downward motion along centerline CL. As the current increases, increasing magnetic force across air gap 69 acts on armature 46 to move it and stem 82 increasingly downward. When the current has increased sufficiently to close the gap between stem 82 and the head of fastener 120 as in FIG. 4, continued increase in current will commence operating valve mechanism 32 to unseat head 114 from seat 102 and allow flow from inlet port 16 through passageway 30 to outlet port 20. The magnetic force then begins to be resisted by both springs 88 and 108. Spring 88 has a positive spring constant $K_s$ that remains substantially constant across the range of compression to which the spring is subjected in valve 10. Likewise spring 108 has a similar positive spring constant $K_v$ that remains substantially constant across the range of compression to which the spring is subjected in valve 10. For given springs, the extent to which the valve opens is therefore a function of magnetic force that acts on armature 46.

The functional relationship of magnetic force created by solenoid 36 (and hence armature displacement and resulting valve opening) to electric current in coil 38 is defined by various parameters in the magnetic circuit of solenoid 36, including various dimensions of, and various dimensional relationships between, the stator and armature at air gap 69.

Over a range of initial armature displacements, the flux pattern is determined to a significant extent by the tapered end portion of wall 54. The thickness of the narrow end of the tapered wall, as measured radially, and the taper angle of the inner surface 64 above shoulder 66 are believed important to the flux pattern. Because wall 74 will overlap an increasing thickness of wall 54 as armature 46 is displaced downward due to the taper of the latter wall, the flux pattern will change in dependence on wall thickness and taper. Proper selection of those two parameters is considered a significant factor in creating a desired relationship of armature displacement to coil current over this range of initial armature displacements.

It is also believed that the radial spacing of armature wall 74 relative to the upper and lower stator walls 48, 54 at air gap 69 is a factor in realizing desired armature force/displacement versus coil current. The radial thickness of non-metallic part 72 determines how far armature 46 is spaced inward of stator wall 48 along the length of part 72. The length of part 72 determines the beginning of the portion of the armature that is allowed to be closer to wall 48. The thickness of the portion of the armature below shoulder 80, and the distances at which it is spaced radially from walls 48 and 54 is another factor, especially as armature 46 is displaced downward to increasingly overlap the tapered portion of wall 54.

Figure 5:
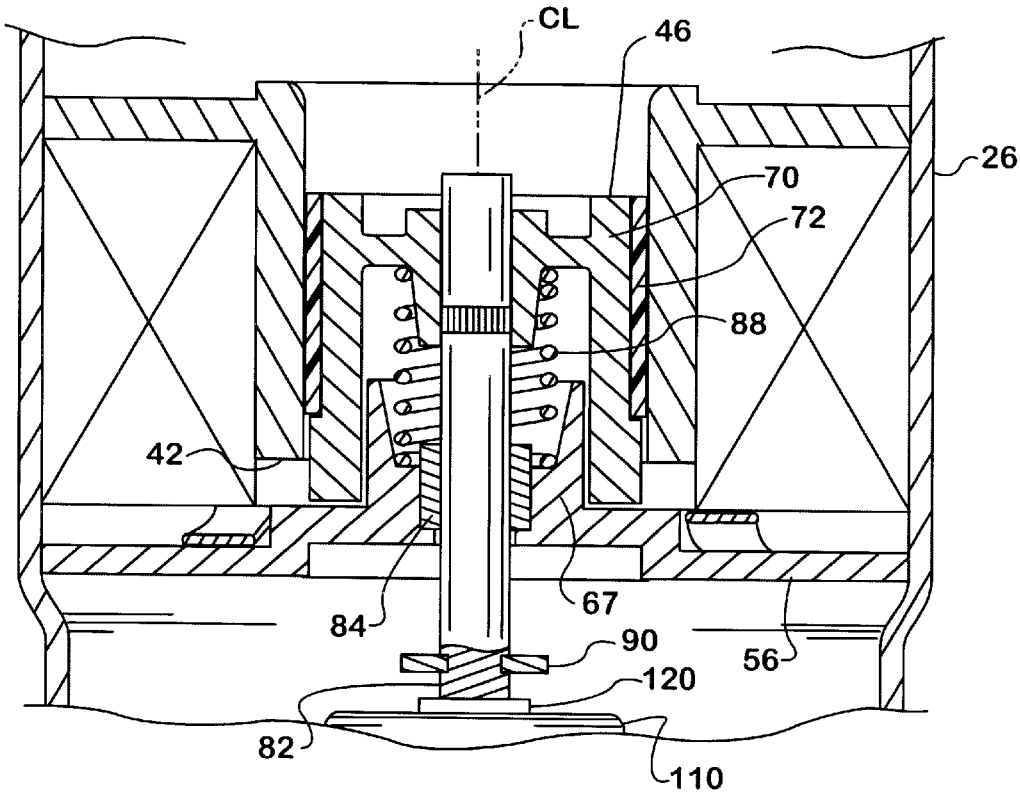
FIG. 5 is a view like FIG. 3 showing another condition of operation.

As armature 46 approaches a condition of maximum displacement as shown by FIG. 5, the end of wall 74 begins to overlap portion 67 of wall 54 and to close toward the portion of flange 56 that lies radially inward of shoulder 58. The magnetic flux pattern will then change in a way that begins to reduce the influence of the tapered portion of wall 54 and increase the influence of portion 67 and flange 56 as the armature is displaced toward maximum displacement because flux is shunted away from the tapered portion toward portion 67 and flange 56.

Figure 6:
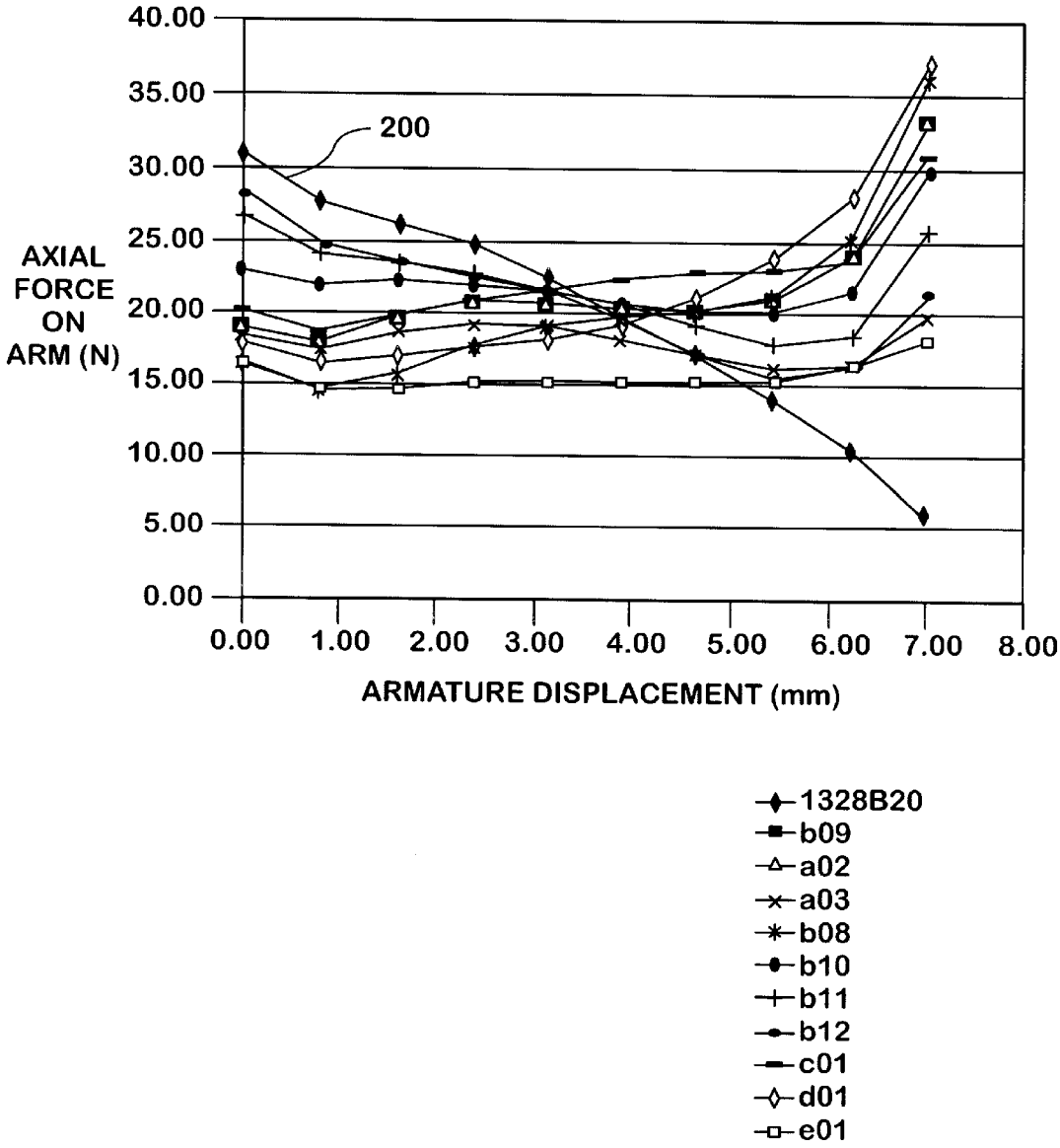
FIG. 6 is a graph containing a series of graph plots of a functional relationship to show the effect of certain changes on that relationship.

The invention is believed to provide advantages lacking in certain prior valves in which the armature is disposed radially inward of both upper and lower stator parts. That arrangement of the armature to the stator factor is believed to constrain the creation of certain force/displacement versus current characteristics that would be desirable for certain EGR valves. A graph plot 200 in FIG. 6 is representative of such a prior valve. By contrast, the other graph plots, which are identified by legend accompanying the graph, are representative of valves embodying principles of the invention.

Each of these other graph plots corresponds to a basic valve, as described above, that has been adapted in a particular way, such as by changing the taper of wall 54, the spacing of armature part 70 to coil 38, the thickness of armature part 72, the spacing between stator walls 48 and 54, and certain dimensions of the lower stator part. It can be appreciated that the invention enables valves having different plots to be realized with essentially only dimensional changes in the basic valve. The data points of each plot are for a constant current of one ampere in coil 38. The y-axis represents the axial component of magnetic force (measured in Newtons) applied to armature 46 while the x-axis represents armature displacement (measured in millimeters) from the closed condition of the valve. The plots show that the initial opening force per unit of coil current can be varied over about a two to one range for the examples presented. They also show that various examples in which the force per unit of coil current can be made fairly constant, made to decrease gradually, or made to increase gradually, over a majority of the displacement range, until, in all examples, the armature approaches maximum displacement where the force per unit of coil current begins to significantly increase due to shunting of flux away from the tapered portion of wall 54 and into portion 67 and the adjoining portion of flange 56. In all examples, the force per unit of coil current decreases during initial displacement, and by providing a lost-motion between actuator 34 and valve mechanism 32 until armature 46 has been displaced sufficiently for the slope of a graph plot to cease decreasing, better linearity may be obtained.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An emission control valve for controlling flow of gases with respect to combustion chamber space of an internal combustion engine comprising:

a valve body comprising a passageway having an inlet port for receiving gases, an outlet port for delivering gases to the combustion chamber space, a valve element that is selectively positioned to selectively restrict the passage, and an electric actuator for selectively positioning the valve element, wherein the actuator comprises a solenoid having an electromagnet coil and a stator associated with the coil, and the stator has an annular air gap disposed within a central interior space of the coil concentric with the centerline, and wherein the valve further comprises an armature that comprises an annular wall disposed in the air gap concentric with the centerline and that is displaced along the centerline as a function of magnetic flux created in the air gap by electric current in the coil to operate the valve element, the air gap is cooperatively defined by juxtaposed walls of the stator that are concentric with the centerline and spaced apart radially a distance greater than radial thickness of the annular wall of the armature, and the annular wall of the armature is disposed radially intermediate the stator walls and spaced radially from each stator wall.

2. An emission control valve as set forth in claim 1 wherein the armature comprises a ferromagnetic part that contains the annular wall disposed in the air gap, the annular wall extends with the interior space of the coil away from the air gap to overlap one of the stator walls, and where the annular wall of the ferromagnetic part overlaps the one stator wall, an annular non-ferromagnetic wall is disposed radially between the one stator wall and the annular wall of the ferromagnetic part.

3. An emission control valve as set forth in claim 2 wherein the annular non-ferromagnetic wall comprises a bearing that guides displacement of the armature on the one stator wall.

4. An emission control valve as set forth in claim 3 wherein the non-ferromagnetic wall comprises a circular cylindrical part that is disposed on the annular wall of the ferromagnetic part.

5. An emission control valve as set forth in claim 4 wherein the ferromagnetic part comprises a shoulder that separates a portion of the annular wall on which the circular cylindrical part is disposed from an adjoining portion of the annular wall which is disposed at the air gap and on which the non-ferromagnetic part is not disposed, and that adjoining portion of the annular wall protrudes radially beyond the portion on which the non-ferromagnetic part is disposed.

6. An emission control valve as set forth in claim 5 wherein another of the stator walls that is juxtaposed to the one stator wall comprises a tapered wall that overlaps the one stator wall and forms a radially inner boundary for the air gap, and the one stator wall comprises a circular wall that is parallel with the centerline.

7. An emission control valve as set forth in claim 6 wherein the tapered wall comprises a radially outer surface that is circular about the centerline, and a radially inner surface that is tapered about the centerline.

8. An emission control valve as set forth in claim 7 wherein the tapered radially inner surface ends at a shoulder, and beyond the shoulder, the another stator wall continues as a circular cylindrical wall having a radially outer surface of the same diameter as that of the radially outer surface of the tapered wall.

9. An emission control valve as set forth in claim 8 wherein the stator includes a radial flange extending from the another stator wall in covering relation to an end of the coil, and the adjoining portion of the annular wall of the armature that protrudes radially beyond the portion on which the non-ferromagnetic part is disposed has an end surface that closes toward the radial flange as the armature is displaced toward maximum displacement and that shunts flux away from the air gap toward the flange as the armature is displaced toward maximum displacement.

10. An emission control valve as set forth in claim 1 including a spring that biases the valve element to close the passageway and a lost-motion connection between the armature and the valve element that allows initial armature displacement without accompanying operation of the valve element so that the passageway remains closed during the initial armature displacement.

11. An automotive vehicle emission control system that includes an emission control valve for controlling flow of gases with respect to combustion chamber space of internal combustion engine that powers the vehicle, wherein the valve comprises:

a valve body comprising a passageway having an inlet port for receiving gases, an outlet port for delivering gases to the combustion chamber space, a valve element that is selectively positioned to selectively restrict the passage, and an electric actuator for selectively positioning the valve element, wherein the actuator comprises a solenoid having an electromagnet coil and a stator associated with the coil, and the stator has an annular air gap disposed within a central interior space of the coil concentric with the centerline, and wherein the valve further comprises an armature that comprises an annular wall disposed in the air gap concentric with the centerline and that is displaced along the centerline as a function of magnetic flux created in the air gap by electric current in the coil to operate the valve element, the air gap is cooperatively defined by juxtaposed walls of the stator that are concentric with the centerline and spaced apart radially a distance greater than radial thickness of the annular wall of the armature, and the annular wall of the armature is disposed radially intermediate the stator walls and spaced radially from each stator wall.

12. An automotive vehicle emission control system as set forth in claim 11 including an electronic engine controller that controls various engine functions including the energization of the electromagnet coil.

13. An automotive vehicle emission control system as set forth in claim 12 wherein the emission control valve is arranged to control recirculation of engine exhaust gas.

* * * * *